US008889976B2

(12) United States Patent
Nakadai et al.

(10) Patent No.: US 8,889,976 B2
(45) Date of Patent: Nov. 18, 2014

(54) MUSICAL SCORE POSITION ESTIMATING DEVICE, MUSICAL SCORE POSITION ESTIMATING METHOD, AND MUSICAL SCORE POSITION ESTIMATING ROBOT

(75) Inventors: Kazuhiro Nakadai, Wako (JP); Takuma Otsuka, Wako (JP); Hiroshi Okuno, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 502 days.

(21) Appl. No.: 12/851,994

(22) Filed: Aug. 6, 2010

(65) Prior Publication Data

US 2011/0036231 A1 Feb. 17, 2011

Related U.S. Application Data

(60) Provisional application No. 61/234,076, filed on Aug. 14, 2009.

(51) Int. Cl.

| | |
|---|---|
| ***G04B 13/00*** | (2006.01) |
| ***G10H 1/36*** | (2006.01) |
| *G10L 25/90* | (2013.01) |

(52) U.S. Cl.

CPC ..... *G10H 1/361* (2013.01); *G10H 2250/235* (2013.01); *G10H 2210/066* (2013.01); *G10H 2210/076* (2013.01); *G10L 25/90* (2013.01)

USPC ..... 84/609; 84/610; 84/616; 84/649; 84/650; 84/654; 84/477 R

(58) Field of Classification Search

CPC . G10H 1/40; G10H 2210/076; G10H 1/0025; G10H 2210/071; G10H 2220/015; G10H 2240/141; G10H 2210/061; G10H 2210/051; G10H 2210/056; G10H 2220/081; G10H 2210/341; G10H 2210/381; G10H 2240/075; G10H 2210/361; G10H 2240/131; G10H 2250/641; G10H 1/18; G10H 2210/081; G09B 15/00; G09B 5/04; G06F 17/30026

See application file for complete search history.

(56) References Cited

U.S. PATENT DOCUMENTS

| | | | | |
|---|---|---|---|---|
| 5,952,597 | A * | 9/1999 | Weinstock et al. | 84/609 |
| 6,107,559 | A * | 8/2000 | Weinstock et al. | 84/634 |

(Continued)

FOREIGN PATENT DOCUMENTS

| | | |
|---|---|---|
| JP | 3147846 | 3/2001 |
| JP | 2006-201278 | 8/2006 |

OTHER PUBLICATIONS

Cont, Arshia, "Realtime Audio to Score Alignment for Polyphonic Music Instruments Using Sparse Non-negative Constraints and Hierarchical HMMS," IEEE International Conference on Acoustics, Speech and Signal Processing, ICASSP 2006 Proceedings, vol. 5:V-245-V-248 (2006).

(Continued)

*Primary Examiner* — Marlon Fletcher

(74) *Attorney, Agent, or Firm* — Nelson Mullins Riley & Scarborough LLP; Anthony A. Laurentano

(57) ABSTRACT

A musical score position estimating device includes an audio signal acquiring unit, a musical score information acquiring unit acquiring musical score information corresponding to an audio signal acquired by the audio signal acquiring unit, an audio signal feature extracting unit extracting a feature amount of the audio signal, a musical score feature extracting unit extracting a feature amount of the musical score information, a beat position estimating unit estimating a beat position of the audio signal, and a matching unit matching the feature amount of the audio signal with the feature amount of the musical score information using the estimated beat position to estimate a position of a portion in the musical score information corresponding to the audio signal.

10 Claims, 15 Drawing Sheets

(56) References Cited

U.S. PATENT DOCUMENTS

| | | | | |
|---|---|---|---|---|
| 7,179,982 | B2 * | 2/2007 | Goto | 84/616 |
| 7,838,755 | B2 * | 11/2010 | Taub et al. | 84/609 |
| 7,966,327 | B2 * | 6/2011 | Li et al. | 707/737 |
| 8,035,020 | B2 * | 10/2011 | Taub et al. | 84/600 |
| 8,076,566 | B2 * | 12/2011 | Yamashita et al. | 84/611 |
| 8,178,770 | B2 * | 5/2012 | Kobayashi | 84/613 |
| 8,296,390 | B2 * | 10/2012 | Wood | 709/217 |
| 2002/0172372 | A1 * | 11/2002 | Tagawa et al. | 381/56 |
| 2005/0182503 | A1 * | 8/2005 | Lin et al. | 700/94 |
| 2008/0002549 | A1 * | 1/2008 | Copperwhite et al. | 369/83 |
| 2009/0056526 | A1 * | 3/2009 | Yamashita et al. | 84/611 |
| 2009/0139389 | A1 * | 6/2009 | Bowen | 84/636 |
| 2009/0228799 | A1 * | 9/2009 | Verbeeck et al. | 715/727 |
| 2009/0288546 | A1 * | 11/2009 | Takeda | 84/612 |
| 2010/0126332 | A1 * | 5/2010 | Kobayashi | 84/613 |
| 2010/0212478 | A1 * | 8/2010 | Taub et al. | 84/645 |
| 2010/0313736 | A1 * | 12/2010 | Lenz | 84/477 R |
| 2011/0036231 | A1 * | 2/2011 | Nakadai et al. | 84/477 R |
| 2011/0214554 | A1 * | 9/2011 | Nakadai et al. | 84/477 R |
| 2012/0031257 | A1 * | 2/2012 | Saino | 84/622 |
| 2012/0101606 | A1 * | 4/2012 | Miyajima | 700/94 |
| 2012/0132057 | A1 * | 5/2012 | Kristensen | 84/650 |
| 2013/0226957 | A1 * | 8/2013 | Ellis et al. | 707/769 |

OTHER PUBLICATIONS

Dannenberg, Roger B. et al., "Polyphonic Audio Matching for Score Following and Intelligent Audio Editors," Proceedings of the 2003 International Computer Music Conference, pp. 27-33 (2003).

Murata, Kazumasa et al., "A Robot Uses Its Own Microphone to Synchronize Its Steps to Musical Beats While Scatting and Singing," IEEE/RSJ International Conference on Intelligent Robots and Systems, pp. 2459-2464 (2008).

Orio, Nicola et al., "Score Following: State of the Art and New Developments," Proceedings of the 2003 Conference on New Interfaces for Musical Expression, pp. 36-41 (2003).

Bello, Juan Pablo et al., "Techniques for Automatic Music Transcription," International Symposium on Music Information Retrieval, pp. 1-8 (2000).

Otsuka, Takuma et al., "Real-time Synchronization Method between Audio Signal and Score Using Beats, Melodies, and Harmonies for Singer Robots," 71st National Convention of Information Processing Society of Japan, pp. 2-243-2-244 (2009) X.

Japanese Office Action for Application No. 2010-177968, 6 pages, dated Mar. 4, 2014.

Cemgil, Ali Taylan et al., "On tempo tracking: Tempogram Representation and Kalman filtering," Journal of New Music Research, vol. 28(4), 19 pages, (2001).

* cited by examiner (a)

FIG. 8

| Symbols | Definitions |
|---|---|
| $i$ | index for 12 pitch names(C,C#,···,B) |
| $t$ | time frame of audio signal |
| $n$ | index for onsets in audio signal |
| $t_n$ | n-th onset time in audio signal |
| $f$ | frame index of musical score |
| $m$ | index for onsets in musical score |
| $f_m$ | m-th onset time frame in musical score |

(a)

(b)

| | Clean signal | | Reverberated signal | |
|---|---|---|---|---|
| | Ave. | Std. dev. | Ave. | Std. dev. |
| (1)Our method | 8.9 | 11.0 | 9.9 | 12.6 |
| (2)w/o SKF | 11.6 | 12.8 | 10.5 | 11.2 |
| (3)w/o rareness | 9.7 | 13.5 | 10.3 | 13.3 |
| (4)Beat tracking | 12.5 | 9.7 | 11.5 | 9.1 |

MUSICAL SCORE POSITION ESTIMATING DEVICE, MUSICAL SCORE POSITION ESTIMATING METHOD, AND MUSICAL SCORE POSITION ESTIMATING ROBOT

CROSS REFERENCE TO RELATED APPLICATIONS

This application claims benefit from U.S. Provisional application Ser. No. 61/234,076, filed Aug. 14, 2009, the contents of which are incorporated herein by reference.

BACKGROUND OF THE INVENTION

1. Field of the Invention

The present invention relates to a musical score position estimating device, a musical score position estimating method, and a musical score position estimating robot.

2. Description of Related Art

In recent years, thanks to remarkable developments in the physical functions of robots, attempts have been made to support humans doing housework or nursing. For the purpose of coexistence of humans and robots, there is a need for natural interaction between robots and humans.

An example of a communication as an interaction between a human and a robot is a communication using music. Music plays an important role in communication between humans and, for example, persons who do not share a language can share a friendly and joyful time through the music. Accordingly, being able to interact with humans through music is essential for robots to live in harmony with humans.

As situations in which robots communicate with humans through music, for example, it can be thought that the robots could sing to accompaniments or singing voices or move their bodies to the music.

Regarding such a robot, techniques of analyzing musical score information and causing the robots to move on the basis of the analysis result are known.

As a technique of recognizing what musical note is described in a musical score, a technique of converting image data of a musical score into musical note data and automatically recognizing the musical score has been suggested (for example, JP Patent No. 3147846). As a technique of analyzing a metrical structure of tune data on the basis of musical score data and structure analysis data grouped in advance and estimating tempos from audio signals in performance, a beat tracking method has been suggested (for example, see JP-A-2006-201278).

In the technique of analyzing the metrical structure described in JP-A-2006-201278, only the structure based on the musical score is analyzed. Accordingly, when a robot tries to sing to audio signals collected by the robot and a piece of music is started from the middle part thereof, it is not clear what portion of the music is currently performed, and thus the robot fails to extract the beat time or tempo of the piece in performance. In addition, when a human performs a piece of music, the tempo of the performance may vary and thus there is a problem in that the robot may fail to extract the beat time or tempo of the piece in performance.

In the past, the metrical structure or the beat time or the tempo of the piece of music was extracted on the basis of the musical score data. Accordingly, when a piece of music is actually performed, it is not possible to detect what portion of the musical score is currently performed with high precision.

SUMMARY OF THE INVENTION

The invention is made in consideration of the above-mentioned problems and it is an object of the invention to provide a musical score position estimating device, a musical score position estimating method, and a musical score position estimating robot, which can estimate a position of a portion in a musical score in performance.

According to a first aspect of the invention, there is provided a musical score position estimating device including: an audio signal acquiring unit; a musical score information acquiring unit acquiring musical score information corresponding to an audio signal acquired by the audio signal acquiring unit; an audio signal feature extracting unit extracting a feature amount of the audio signal; a musical score feature extracting unit extracting a feature amount of the musical score information; a beat position estimating unit estimating a beat position of the audio signal; and a matching unit matching the feature amount of the audio signal with the feature amount of the musical score information using the estimated beat position to estimate a position of a portion in the musical score information corresponding to the audio signal.

According to a second aspect of the invention, the musical score feature extracting unit may calculate rareness which is an appearance frequency of a musical note from the musical score information, and the matching unit may make a match using rareness.

According to a third aspect of the invention, the matching unit may make a match on the basis of the product of the calculated rareness, the extracted feature amount of the audio signal, and the extracted feature amount of the musical score information.

According to a fourth aspect of the invention, rareness may be the lowness in appearance frequency of a musical note in the musical score information.

According to a fifth aspect of the invention, the audio signal feature extracting unit may extract the feature amount of the audio signal using a chroma vector, and the musical score feature extracting unit may extract the feature amount of the musical score information using a chroma vector.

According to a sixth aspect of the invention, the audio signal feature extracting unit may weight a high-frequency component in the extracted feature amount of the audio signal and calculate an onset time of a musical note on the basis of the weighted feature amount, and the matching unit may make a match using the calculated onset time of a musical note.

According to a seventh aspect of the invention, the beat position estimating unit may estimate the beat position by switching a plurality of different observation error models using a switching Kalman filter.

According to another aspect of the invention, there is provided a musical score position estimating method including: an audio signal acquiring step of causing an audio signal acquiring unit to acquire an audio signal; a musical score information acquiring step of causing a musical score information acquiring unit to acquire musical score information corresponding to the acquired audio signal; an audio signal feature extracting step of causing an audio signal feature extracting unit to extract a feature amount of the audio signal; a musical score information feature extracting step of causing a musical score feature extracting unit to extract a feature amount of the musical score information; a beat position estimating step of causing a beat position estimating unit to estimate a beat position of the audio signal; and a matching step of causing a matching unit to match the feature amount of the audio signal with the feature amount of the musical score information using the estimated beat position to estimate a position of a portion in the musical score information corresponding to the audio signal.

According to another aspect of the invention, there is provided a musical score position estimating robot including: an audio signal acquiring unit; an audio signal separating unit extracting an audio signal corresponding to a performance by performing a suppression process on the audio signal acquired by the audio signal acquiring unit; a musical score information acquiring unit acquiring musical score information corresponding to the audio signal extracted by the audio signal separating unit; an audio signal feature extracting unit extracting a feature amount of the audio signal extracted by the audio signal separating unit; a musical score feature extracting unit extracting a feature amount of the musical score information; a beat position estimating unit estimating a beat position of the audio signal extracted by the audio signal separating unit; and a matching unit matching the feature amount of the audio signal with the feature amount of the musical score information using the estimated beat position to estimate a position of a portion in the musical score information corresponding to the audio signal.

According to the first aspect of the invention, the feature amount and the beat position are extracted from the acquired audio signal and the feature amount is extracted from the acquired musical score information. By matching the feature amount of the audio signal with the feature amount of the musical score information using the extracted beat position, the position of a portion in the musical score information corresponding to the audio signal is estimated. As a result, it is possible to accurately estimate a position of a portion in a musical score on the basis of the audio signal.

According to the second aspect of the invention, since rareness which is the lowness in appearance frequency of a musical note is calculated from the musical score information and the match is made using the calculated rareness, it is possible to accurately estimate a position of a portion in a musical score on the basis of the audio signal with high precision.

According to the third aspect of the invention, since the match is made on the basis of the product of rareness, the feature amount of the audio signal, and the feature amount of the musical score information, it is possible to accurately estimate a position of a portion in a musical score on the basis of the audio signal with high precision.

According to the fourth aspect of the invention, since the lowness in appearance frequency of a musical note is used as rareness, it is possible to accurately estimate a position of a portion in a musical score on the basis of the audio signal with high precision.

According to the fifth aspect of the invention, since the feature amount of the audio signal and the feature amount of the musical score information are extracted using the chroma vector, it is possible to accurately estimate a position of a portion in a musical score on the basis of the audio signal with high precision.

According to the sixth aspect of the invention, since the high-frequency component in the feature amount of the audio signal is weighted and the match is made using the onset time of a musical note on the basis of the weighted feature amount, it is possible to accurately estimate a position of a portion in a musical score on the basis of the audio signal with high precision.

According to the seventh aspect of the invention, the beat position is estimated by switching plural different observation error models using the switching Kalman filter. Accordingly, when the performance starts to differ from the tempo of the musical score, it is possible to accurately estimate a position of a portion in a musical score on the basis of the audio signal with high precision.

BRIEF DESCRIPTION OF THE DRAWINGS

FIG. 8 is a list illustrating symbols in an expression used for an audio signal feature extracting unit according to the embodiment of the invention to extract chroma vectors and onset times.

DETAILED DESCRIPTION OF THE INVENTION

Hereinafter, exemplary embodiments of the invention will be described in detail with reference to the accompanying drawings. The invention is not limited to the embodiments, but can be modified in various forms without departing from the technical spirit of the invention.

Figure 1:
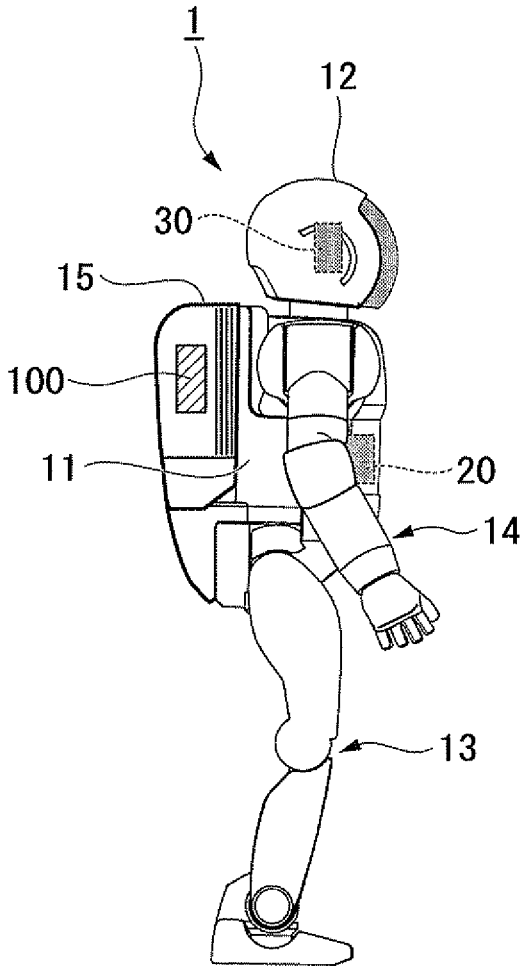
FIG. 1 is a diagram illustrating a robot having a musical score position estimating device according to an embodiment of the invention.

FIG. 1 is a diagram illustrating a robot 1 having a musical score position estimating device 100 according to an embodiment of the invention. As shown in FIG. 1, the robot 1 includes a body 11, a head 12 (movable part) movably connected to the body 11, a leg part 13 (movable part), and an arm part 14 (movable part). The robot 1 further includes a reception part 15 carried on the back of the body 11. A speaker 20 is received in the body 11 and a microphone 30 is received in the head 12. FIG. 1 is a side view of the robot 1, and plural microphones 30 and plural speakers 20 are built symmetrically therein as viewed from the front side.

Figure 2:
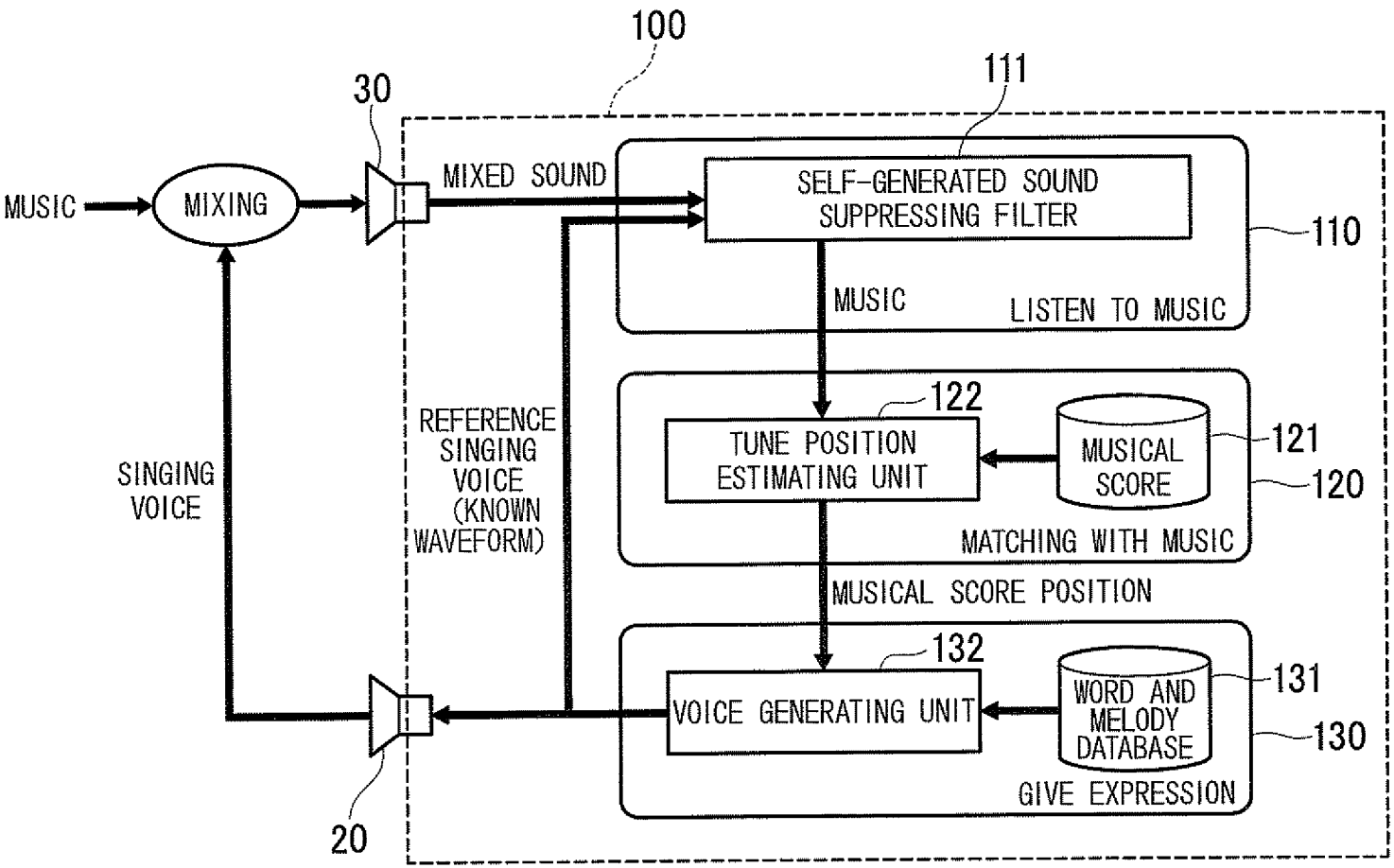
FIG. 2 is a block diagram illustrating the configuration of the musical score position estimating device according to the embodiment of the invention.

FIG. 2 is a block diagram illustrating the configuration of the musical score position estimating device 100 according to this embodiment. As shown in FIG. 2, a microphone 30 and a speaker 20 are connected to the musical score position estimating device 100. The musical score position estimating device 100 includes an audio signal separating unit 110, a musical score position estimating unit 120, and a singing voice generating unit 130. The audio signal separating unit 110 includes a self-generated sound suppressing filter unit 111. The musical score position estimating unit 120 includes a musical score database 121 and a tune position estimating unit 122. The singing voice generating unit 130 includes a word and melody database 131 and a voice generating unit 132.

The microphone 30 collects sounds in which sounds of performance (accompaniment) and voice signals (singing voice) output from the speaker 20 of the robot 1 are mixed, converts the collected sounds into audio signals, and outputs the audio signals to the audio signal separating unit 110.

The audio signals collected by the microphone 30 and the voice signals generated from the singing voice generating unit 130 are input to the audio signal separating unit 110. The self-generated sound suppressing filter unit 111 of the audio signal separating unit 110 performs an independent component analysis (ICA) process on the input audio signals and suppresses reverberated sounds included in the generated voice signals and the audio signals. Accordingly, the audio signal separating unit 110 separates and extracts the audio signals based on the performance. The audio signal separating unit 110 outputs the extracted audio signals to the musical score position estimating unit 120.

The audio signals separated by the audio signal separating unit 110 are input to the musical score position estimating unit 120 (the musical score information acquiring unit, the audio signal feature extracting unit, the musical score feature extracting unit, the beat position estimating unit, and the matching unit). The tune position estimating unit 122 of the musical score position estimating unit 120 calculates an audio chroma vector as a feature amount and an onset time from the input audio signals. The tune position estimating unit 122 reads musical score data of a piece of music in performance from the musical score database 121 and calculates a musical score chroma vector as a feature amount from the musical score data and rareness as the appearance frequency of a musical note. The tune position estimating unit 122 performs a beat tracking process from the input audio signals and detects a rhythm interval (tempo). The tune position estimating unit 122 estimates the outlier of the tempo or a noise using a switching Kalman filter (SKF) on the basis of the extracted rhythm interval (tempo) and extracts a stable rhythm interval (tempo). The tune position estimating unit 122 (the audio signal feature extracting unit, the musical score feature extracting unit, the beat position estimating unit, and the matching unit) matches the audio signals based on the performance with the musical score using the extracted rhythm interval (tempo), the calculated audio chroma vector, the calculated onset time information, the musical score chroma vector, and rareness. That is, the tune position estimating unit 122 estimates at what portion of a musical score the tune being performed is located. The musical score position estimating unit 120 outputs the musical score position information representing the estimated musical score position to the singing voice generating unit 130.

It has been stated that the musical score data is stored in advance in the musical score database 121, but the musical score position estimating unit 120 may write and store input musical score data in the musical score database 121.

The estimated musical score position information is input to the singing voice generating unit 130. The voice generating unit 132 of the singing voice generating unit 130 generates a voice signal of a singing voice in accordance with the performance by the use of a known technique on the basis of the input musical score position information and using the information stored in the word and melody database 131. The singing voice generating unit 130 outputs the generated voice signal of a singing voice through the speaker 20.

Next, the outline of an operation will be described in which the audio signal separating unit 110 suppresses reverberated sounds included in the generated voice signals and the audio signals using an independent component analysis. In the independent component analysis, a separation process is performed by assuming independency (i.e., probability density) between sound sources. The audio signals acquired by the robot 1 through the microphone 30 are signals in which the signals of sounds of performance and the voice signals output by the robot 1 using the speaker 20 are mixed. Among the mixed signals, the voice signals output by the robot 1 using the speaker 20 are known because the signals are generated by the voice generating unit 132. Accordingly, the audio signal separating unit 110 carries out an independent component analysis in frequency region to suppress the voice signals of the robot 1 included in the mixed signals, thereby separating the sounds of performance.

Next, the outline of the method employed in the musical score position estimating device 100 according to this embodiment will be described. When the beat or tempo is extracted from the music (accompaniment) being performed to estimate what portion of a musical score is being performed, there are generally three technologies.

Figure 3:
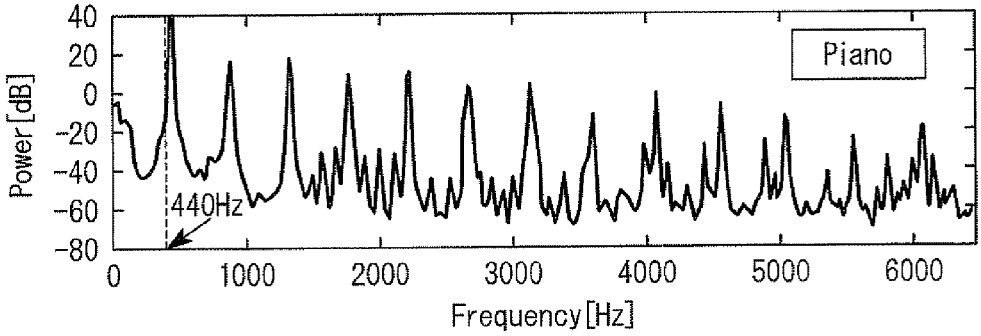
FIG. 3 is a diagram illustrating a spectrum of an audio signal at the time of playing a musical instrument.
Figure 3:
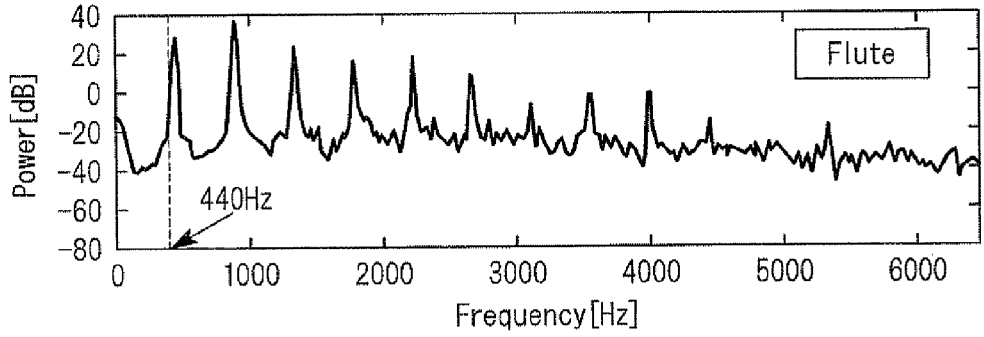

A first technology is how to distinguish various instrument sounds included in the audio signal being performed. FIG. 3 is a diagram illustrating an example of a spectrum of an audio signal at the time of playing an instrument. Part (a) of FIG. 3 shows a spectrum of an audio signal when an A4 sound (440 Hz) is created with a piano and part (b) of FIG. 3 shows a spectrum of an audio signal when the A4 sound is created with a flute. The vertical axis represents the magnitude of a signal and the horizontal axis represents the frequency. As shown in part (a) and part (b) of FIG. 3, in the spectrums analyzed in the same frequency range, the shape or component of the spectrum is different depending on the instruments even with the A4 sound with the same basic frequency of 440 Hz.

Figure 4:
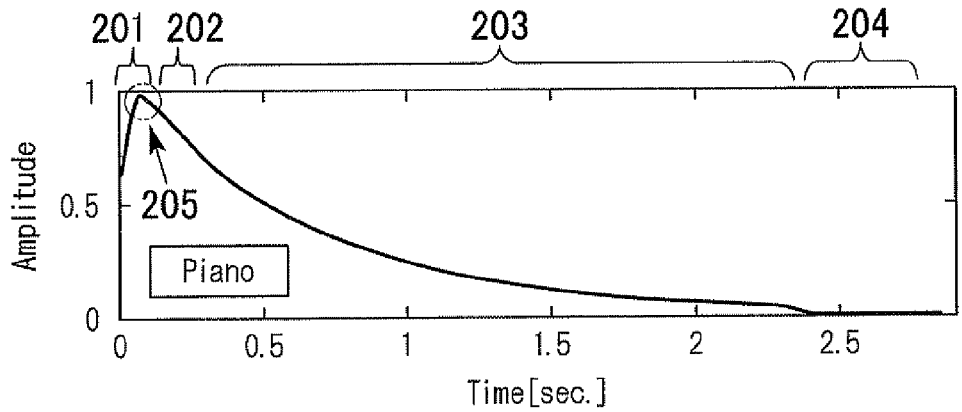
FIG. 4 is a diagram illustrating a reverberation waveform (power envelope) of an audio signal at the time of playing a musical instrument.
Figure 4:
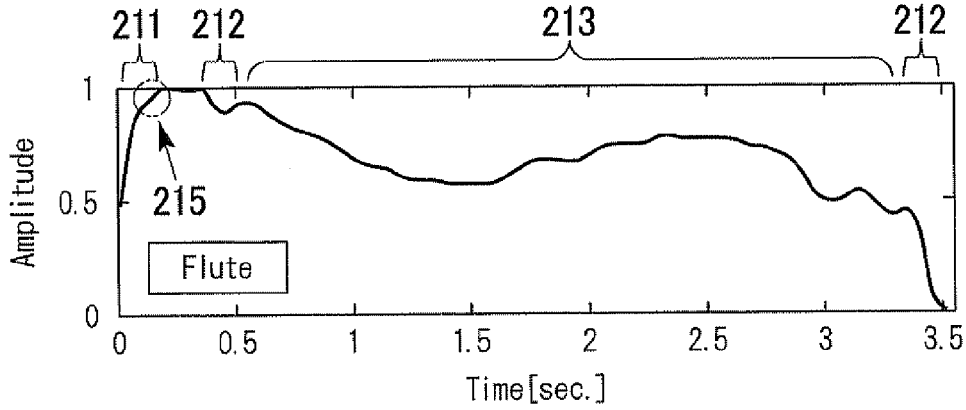

FIG. 4 is a diagram illustrating an example of a reverberation waveform (power envelope) of an audio signal at the time of playing an instrument. Part (a) of FIG. 4 shows a reverberation waveform of an audio signal in a piano and part (b) of FIG. 4 shows a spectrum of an audio signal in a flute. The vertical axis represents the magnitude of a signal and the horizontal axis represents time. In general, the reverberation waveform of an instrument includes an attack (onset) portion (201, 211), an attenuation portion (202, 212), a stabilized portion (203, 213), and a release (runout) portion (204, 214). As shown in part (a) of FIG. 4, the reverberation waveform of an instrument such as a piano or a guitar has a descent stabilized portion 203. As shown in part (b) of FIG. 4, the reverberation waveform of an instrument such as a flute, a violin, or a saxophone includes a lasting stabilized portion 213.

When complex musical notes are performed at the same time with various instruments, in other words, when chordal sounds are treated, it is even more difficult to detect basic frequencies of the musical notes or to recognize the stabilized sounds.

Accordingly, in this embodiment, the onset time (205, 215) which is a starting portion of a waveform in performance is noted.

The musical score position estimating unit 120 extracts a feature amount in a frequency domain using 12-step chroma vectors (audio feature amount). The musical score position estimating unit 120 calculates the onset time which is a feature amount in a time domain on the basis of the extracted feature amount in the frequency domain. The chroma vector has the advantages of being robust against variations in spectrum shape of various instruments, and being effective with respect to chordal sound signals. In the chroma vector, powers of 12 pitch names such as C, C#, . . . , and B are extracted instead of the basic frequencies. In this embodiment, as indicated by the starting portion 205 in part (a) of FIG. 4 and the starting portion 215 in part (b) of FIG. 4, a vertex around a rapidly-rising power is defined as an "onset time". The extraction of the onset time is required to obtain start times of the musical notes in synchronization of a musical score. In the chordal sound signal, the onset time is a portion in which the power rises in the time domain and can be easily extracted from the stabilized portion or the release portion.

Figure 5:
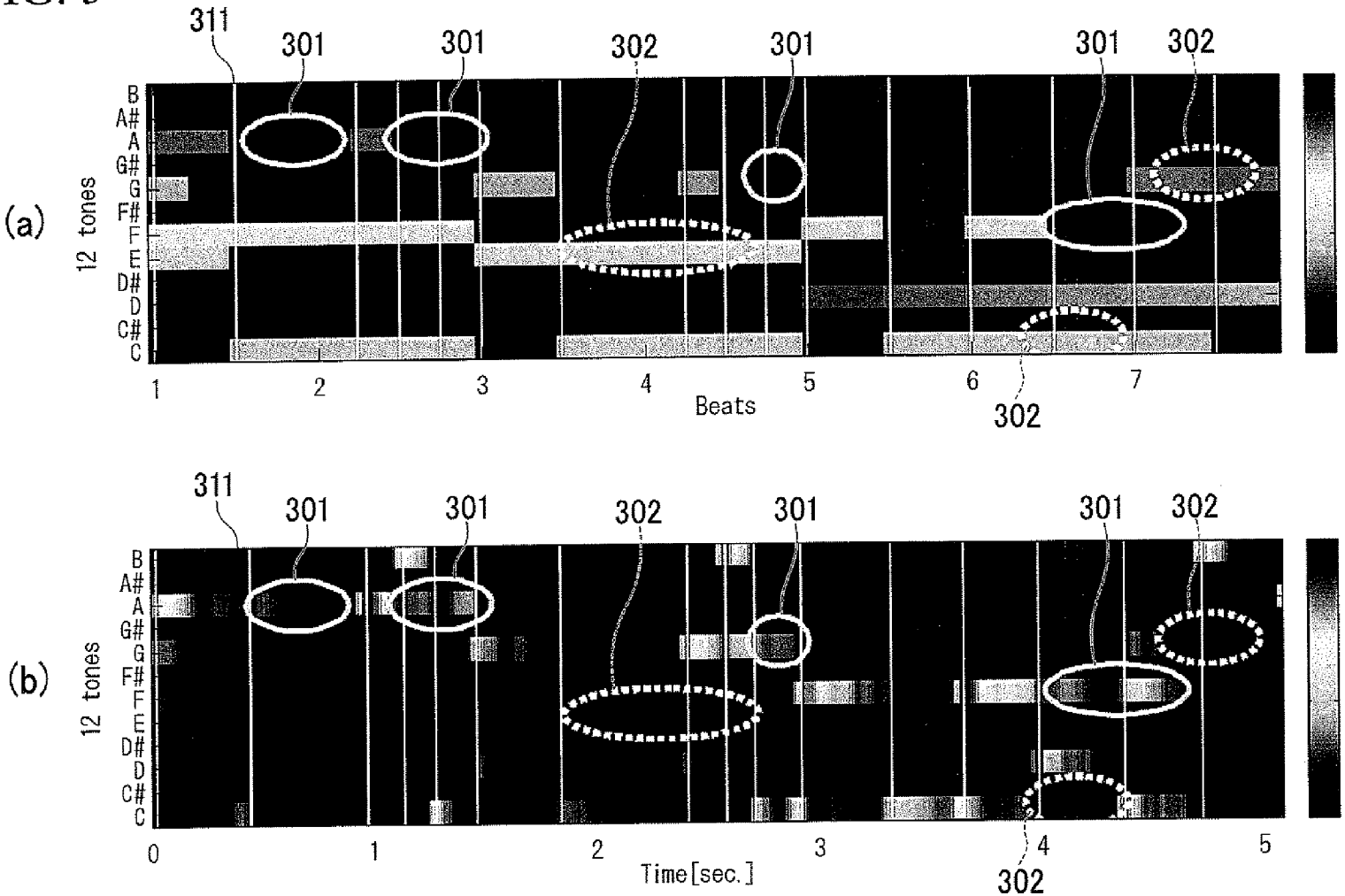
FIG. 5 is a diagram illustrating chroma vectors of an audio signal and a musical score based on an actual performance.

A second technology is estimating a difference between the audio signals in performance and the musical score. FIG. 5 is a diagram illustrating an example of chroma vectors of the audio signals based on the actual performance and the musical score. Part (a) of FIG. 5 shows the chroma vector of the musical score and part (b) of FIG. 5 shows the chroma vector of the audio signals based on the actual performance. The vertical axis in part (a) and part (b) of FIG. 5 represents the 12-tone pitch names, the horizontal axis in part (a) of FIG. 5 represents the beats in the musical score, and the horizontal axis in part (b) of FIG. 5 represents the time. In part (a) and part (b) of FIG. 5, the vertical solid line 311 represents the onset time of each tone (musical note). The onset time in the musical score is defined as a start portion of each note frame.

As shown in part (a) and part (b) of FIG. 5, the chroma vector based on the audio signals based on the actual performance is different from the chroma vector based on the musical score. In the area of reference numeral 301 surrounded with a solid line, the chroma vector does not exist in part (a) of FIG. 5 but the chroma vector exists in part (b) of FIG. 5. That is, even in a part without a musical note in the musical score, the power of the previous tone lasts in the actual performance. In the area of reference numeral 302 surrounded with a dotted line, the chroma vector exists in part (a) of FIG. 5, but the chroma vector is rarely detected in part (b) of FIG. 5.

In the musical score, the volumes of the musical notes are not clearly described.

As described above, in this embodiment, on the basis of the thought that the musical note of a rarely-used pitch name is markedly expressed in the audio signals at some times, the difference between the audio signals and the musical score is reduced. First, the musical score of the piece of music in performance is acquired in advance and is registered in the musical score database 121. The tune position estimating unit 122 analyzes the musical score of the piece in performance and calculates the appearance frequencies of the musical notes. The appearance frequency of each pitch name in the musical score is defined as rareness. The definition of rareness is similar to that of information entropy. In part (a) of FIG. 5, since the number of the pitch name B is smaller than the numbers of other pitch names, rareness of pitch name B is high. On the contrary, pitch name C and pitch name E are frequently used in the musical score and thus rareness thereof is low.

The tune position estimating unit 122 weights the pitch names calculated in this way on the basis of the calculated rareness.

By weighting the pitch names, a low-frequency musical note can be more easily extracted from the chordal audio signals than a high-frequency musical note.

A third technology is estimating a variation in tempo of the audio signals in performance. The stable tempo estimation is essential for the robot 1 to sing in accurate synchronization with the musical score and for the robot 1 to output smooth and pleasant singing voices in accordance with the piece of music in performance. When a human performs a piece of music, the tempo may depart from the tempo indicated by the musical score. The tempo difference is caused at the time of estimating the tempo using a known beat tracking process.

Figure 6:
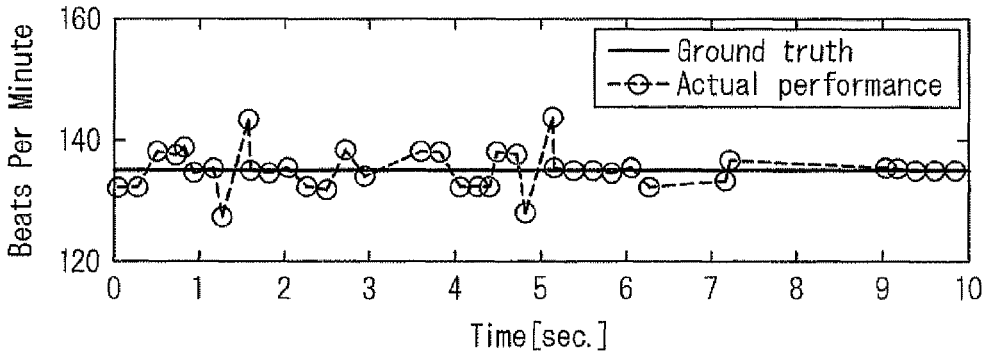
FIG. 6 is a diagram illustrating a variation in speed or tempo of a musical performance.
Figure 6:
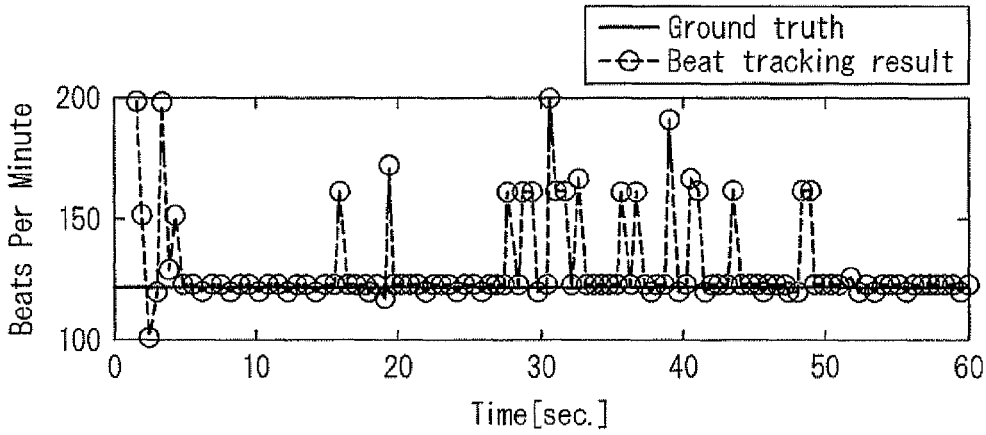

FIG. 6 is a diagram illustrating a variation in speed or tempo at the time of performing a piece of music. Part (a) of FIG. 6 shows a temporal variation of beats calculated from MIDI (registered trademark, Musical Instrument Digital Interface) data strictly matched with a human performance. The tempos can be acquired by dividing the length of a musical note in a musical score by the time length thereof. Part (b) of FIG. 6 shows a temporal variation of beats in the beat tracking. A considerable number of tempo lines include the outliers. The outlier is generally caused due to a variation in a drum pattern. In FIG. 6, the vertical axis represents the number of beats per unit time and the horizontal axis represents time.

Accordingly, in this embodiment, the tune position estimating unit 122 employs the switching Kalman filter (SKF) for the tempo estimation. The SKF allows the estimation of a next tempo from a series of tempos including errors.

Figure 7:
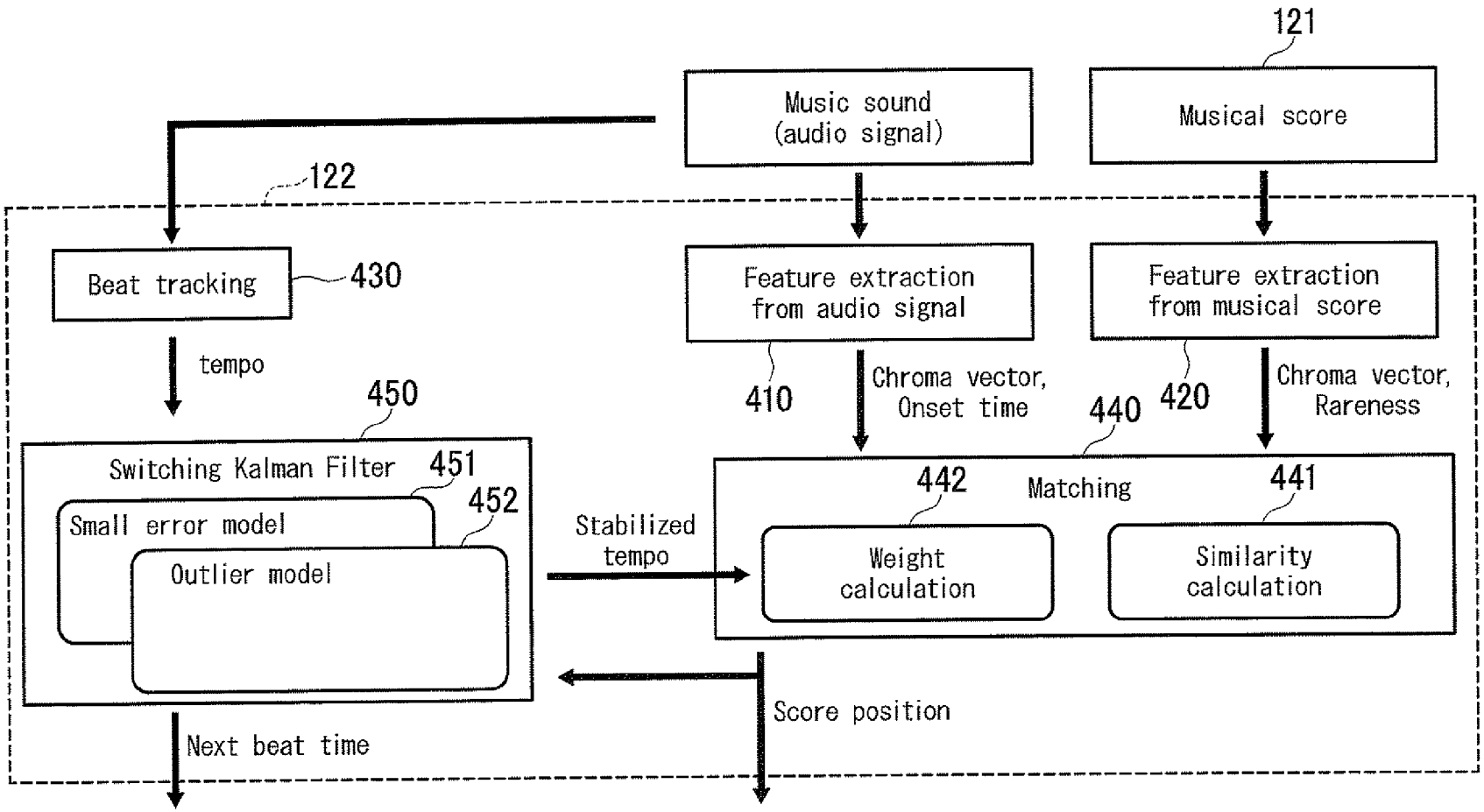
FIG. 7 is a block diagram illustrating the configuration of a musical score position estimating unit according to the embodiment of the invention.

Next, the process performed by the musical score position estimating unit 120 will be described in detail with reference to FIGS. 7 to 12. FIG. 7 is a block diagram illustrating the configuration of the musical score position estimating unit 120. As shown in FIG. 7, the musical score position estimating unit 120 includes the musical score database 121 and the tune position estimating unit 122. The tune position estimating unit 122 includes a feature extracting unit 410 from an audio signal (audio signal feature extracting unit), a feature extracting unit 420 from a musical score (musical score feature extracting unit), a beat interval (tempo) calculating unit 430, a matching unit 440, and a tempo estimating unit 450 (beat position estimating unit). The matching unit 440 includes a similarity calculating unit 441 and a weight calculating unit 442. The tempo estimating unit 450 includes a small observation error model 451 and a large observation error model 452 as the outlier.

Extraction of Feature from Audio Signal

The audio signals separated by the audio signal separating unit 110 are input to the audio signal feature extracting unit 410. The audio signal feature extracting unit 410 extracts the audio chroma vector and the onset time from the input audio signals, and outputs the extracted chroma vector and the onset time information to the beat interval (tempo) calculating unit 430.

FIG. 8 shows a list of symbols in an expression used for the audio signal feature extracting unit 410 to extract the chroma vector and the onset time information. In FIG. 8, i represents indexes of 12 pitch names (C, C#, D, D#, E, F, F#, G, G#, A, A#, and B), t represents the frame time of the audio signal, n represents an index of the onset time in the audio signals, $t_n$ represents an n-th onset time in the audio signal, f represents a frame index of the musical score, m represents an index of the onset time in the musical score, and $f_m$ represents an m-th onset time in the musical score.

The audio signal feature extracting unit 410 calculates a spectrum from the input audio signal using a short-time Fourier transformation (STFT). The short-time Fourier transformation is a technique of multiplying the input audio signal by a window function such as a Hanning window and calculating a spectrum while shifting an analysis position within a finite period. In this embodiment, the Hanning window is set to 4096 points, the shift interval is set to 512 points, and the sampling rate is set to 44.1 kHz. Here, the power is expressed by $p(t,\omega)$, where t represents a frame time and $\omega$ represents a frequency.

Figure 9:
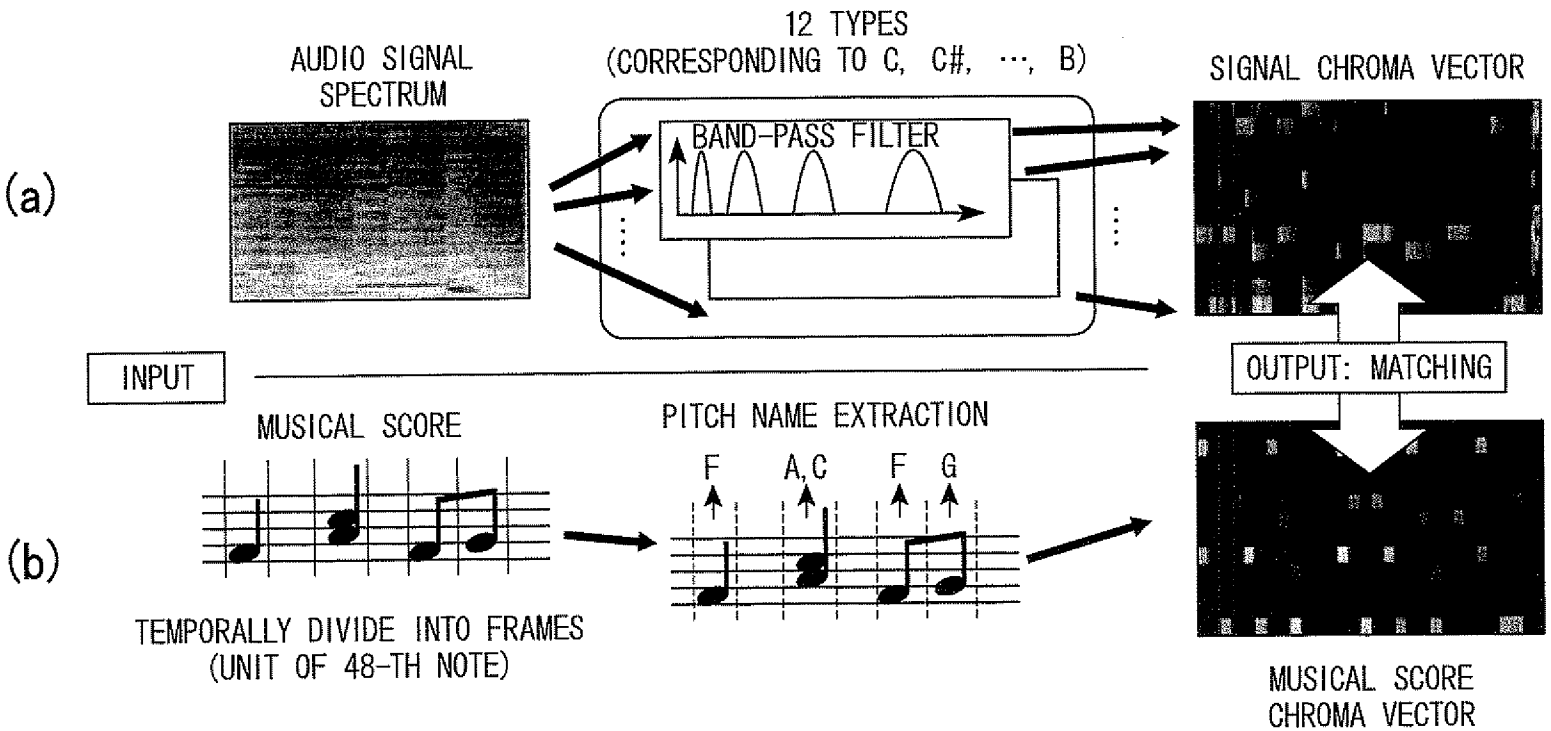
FIG. 9 is a diagram illustrating a procedure of calculating chroma vectors from the audio signal and the musical score according to the embodiment of the invention.

The chroma vector $c(t)=[c(1,t), c(2,t), \ldots, c(12,t)]^T$ (where T represents a transposition of a vector) every frame time t. As shown in FIG. 9, the audio signal feature extracting unit 410 extracts components corresponding to the respective 12 pitch names by the use of band-pass filters of the pitch names, and the components corresponding to the respective 12 pitch names are expressed by Expression 1. FIG. 9 is a diagram illustrating a procedure of calculating a chroma vector from the audio signal and the musical score, where part (a) of FIG. 9 shows the procedure of calculating the chroma vector from the audio signal.

Expression 1

$$c(i,t)=\sum_{h=Oct_L}^{Oct_H}\int_{-\infty}^{\infty}BPF_{i,h}(\omega)p(t,\omega)d\omega \tag{1}$$

In Expression 1, $BPF_{i,h}$ represents the band-pass filter for pitch name i in the h-th octave. $Oct_L$ and $Oct_H$ are lower and higher limit octaves to consider respectively. The peak of the band is the fundamental frequency of the note. The edges of the band are the frequencies of neighboring notes. For example, the BPF for note "A4" (note "A" at the fourth octave) of which the fundamental frequency is 440 Hz has a peak at 440 Hz. The edges of the band are "G#" (note "G#" at the fourth octave) at 415 Hz, and "A#4" at 466 Hz. In this embodiment, $Oct_L=3$ and $Oct_H=7$ are set. In other words, the lowest note is "C3" at 131 Hz and the highest note is "B7" at 3951 Hz.

To emphasize the pitch name, the audio signal feature extracting unit 410 applies the convolution of Expression 2 to Expression 1.

Expression 2

$$\begin{aligned}c'(i,t)=&-c(i+1,t-1)-2c(i+1,t)-c(i+1,t+1)-c(i,t-1)+\\&6c(i,t)+3c(i,t+1)-c(i-1,t-1)-2c(i-1,t)-c(i-1,t+1)\end{aligned} \tag{2}$$

The audio signal feature extracting unit 410 periodically processes the convolution of Expression 2 for index i. For example, when i=1 (pitch name "C"), c(i-1, t) is substituted with c(12, t) (pitch name "B").

By the convolution of Expression 2, the neighboring pitch name power is subtracted and thus a component with more power than others can be emphasized, which may be analogous to edge extraction in image processing. By subtracting the power of the previous time frame, the increase in power is emphasized.

The audio signal feature extracting unit 410 extracts a feature amount by calculating the audio chroma vector $c_{sig}(i,t)$ from the audio signal using Expression 3.

Expression 3

$$c_{sig}(i,t)=\begin{cases}c'(i,t) & (c'(i,t)>0)\\ 0 & \text{otherwise}\end{cases} \tag{3}$$

The audio signal feature extracting unit 410 extracts the onset time from the input audio signal using an onset extracting method (method 1) proposed by Rodet et al.

Reference 1 (method 1): X. Rodet and F. Jaillet. Detection and modeling of fast attack transients. In International Computer Music Conference, pages 30-33, 2001.

The increase in power at the onset time which is located particularly in the high frequency region is used to extract the onset. The onset time of sounds of pitched instruments is located at the center in a higher frequency region than those of percussive instruments such as drums. Accordingly, this method is particularly effective in detecting the onset times of pitched instruments.

First, the audio signal feature extracting unit 410 calculates the power known as a high-frequency component using Expression 4.

Expression 4

$$h(t)=\sum_{\omega}\omega p(t,\omega) \tag{4}$$

Figure 10:
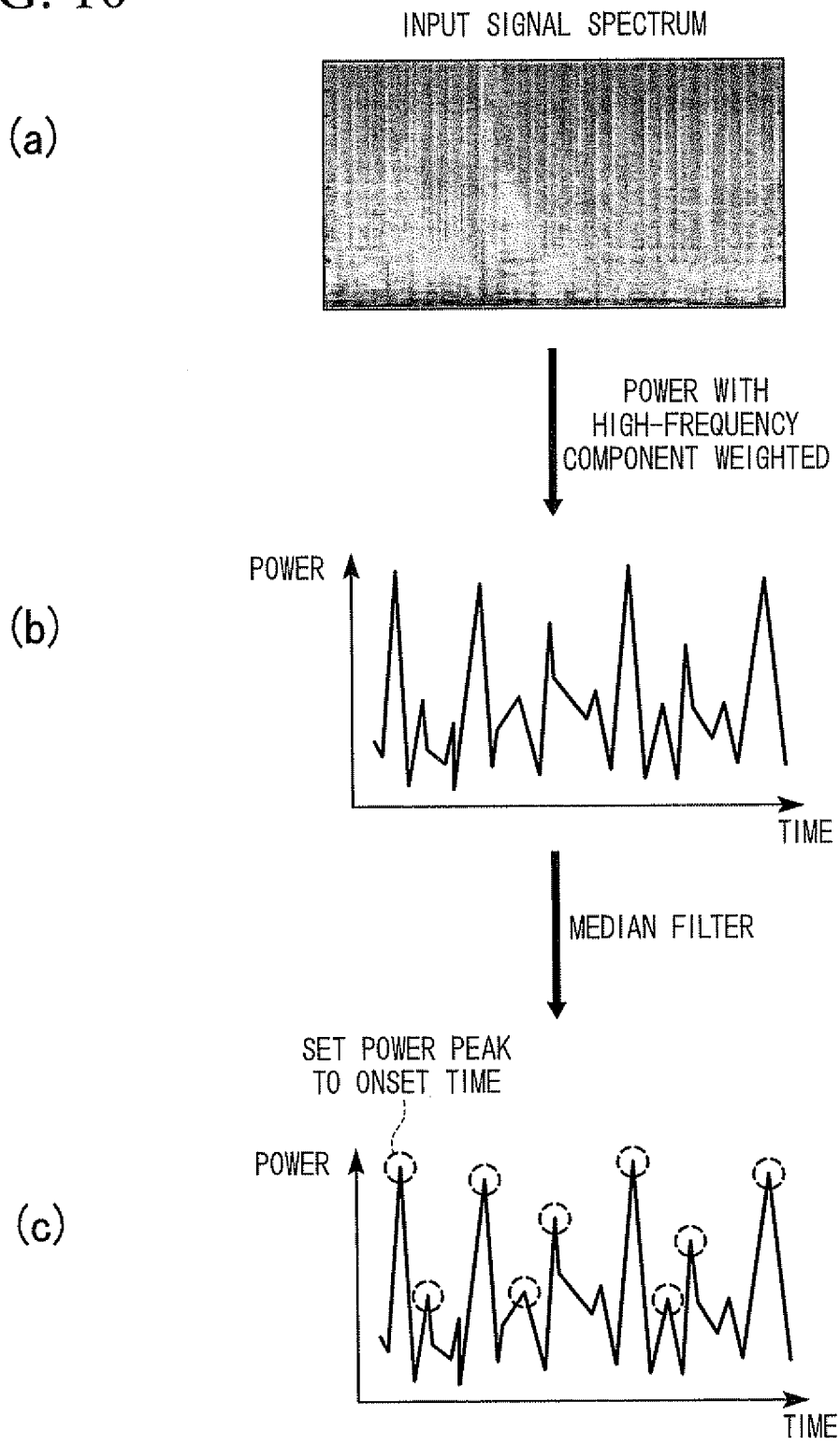
FIG. 10 is a diagram schematically illustrating an onset time extracting procedure according to the embodiment of the invention.

The high-frequency component is a weighted power where the weight increases linearly with the frequency. The audio signal feature extracting unit 410 determines the onset time $t_n$ by selecting the peaks of h(t) using a median filter, as shown in FIG. 10. FIG. 10 is a diagram schematically illustrating the onset time extracting procedure. As shown in FIG. 10, after calculating the spectrum of the input audio signal (part (a) of FIG. 10), the audio signal feature extracting unit 410 calculates the weighted power of the high-frequency component (part (b) of FIG. 10). Then, the audio signal feature extracting unit 410 applies the median filter to the weighted power to calculate the time of the peak power as the onset time (part (c) of FIG. 10).

The audio signal feature extracting unit 410 outputs the extracted audio chroma vectors and the extracted onset time information to the matching unit 440.

Feature Extraction from Musical Score

The musical score feature extracting unit 420 reads necessary musical score data from a musical score stored in the musical score database 121. In this embodiment, it is assumed that music titles to be performed are input to the robot 1 in advance, and the musical score feature extracting unit 420 selects and reads the musical score data of the designated piece of music.

The musical score feature extracting unit 420 divides the read musical score data into frames such that the length of one frame is equal to one-$48^{th}$ of a bar, as shown in part (b) of FIG. 9. This frame resolution can deal with sixth notes and triples. In this embodiment, the feature amount is extracted by calculating musical score chroma vectors using Expression 5. Part (b) of FIG. 9 shows a procedure of calculating chroma vectors from the musical score.

Expression 5

$$c_{sco}(i,m)=\begin{cases}1 & \text{pitch name } i \text{ starts at frame } f_m\\ 0 & \text{otherwise}\end{cases} \tag{5}$$

In Expression 5, $f_m$ represents the m-th onset time in the musical score.

Then, the musical score feature extracting unit 420 calculates rareness r(i,m) of each pitch name i at frame $f_m$ from the extracted chroma vectors using Expression 7.

Expression 6

$$n(i, m) = \frac{\sum_{p \in M} c_{sco}(i, p)}{\sum_{i=1}^{12} \sum_{p \in M} c_{sco}(i, p)} \tag{6}$$

Expression 7

$$r(i, m) = \begin{cases} -\log_2 n(i, m) & (n(i, m) > 0) \\ \max_i(-\log_2 n(i, m)) & (n(i, m) = 0) \end{cases} \tag{7}$$

Here, M represents a frame range of which the length is two bars with its center at frame $f_m$. Therefore, n(i,m) represents the distribution of pitch names around frame $f_m$.

The musical score feature extracting unit 420 outputs the extracted musical score chroma vectors and rareness to the matching unit 440.

Figure 11:
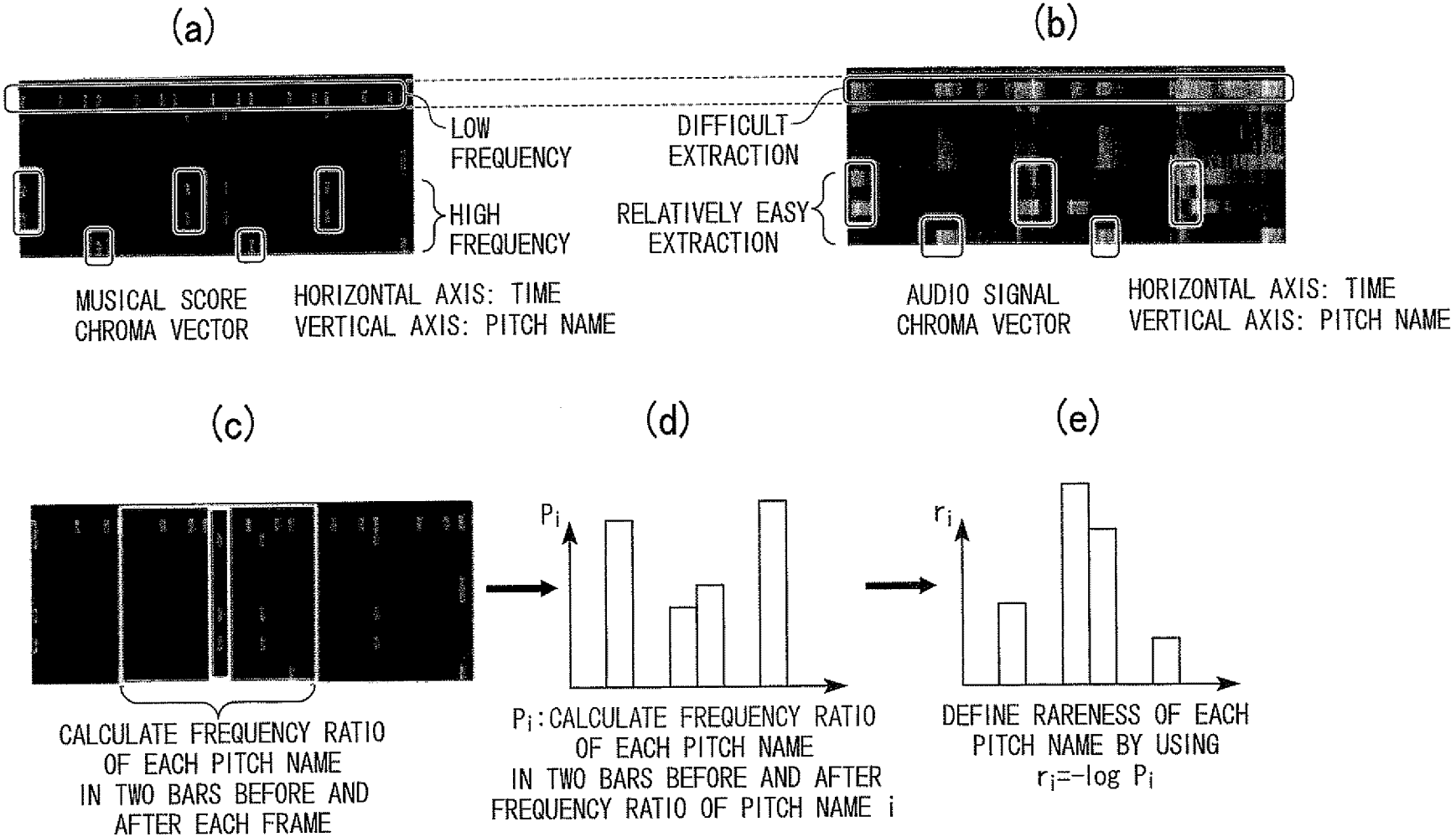
FIG. 11 is a diagram illustrating rareness according to the embodiment of the invention.

FIG. 11 is a diagram illustrating rareness. In parts (a) to (c) of FIG. 11, the vertical axis represents the pitch name and the horizontal axis represents time. Part (a) of FIG. 11 shows the chroma vectors of the musical score and part (b) of FIG. 11 shows the chroma vectors of the performed audio signal. Parts (c) to (e) of FIG. 11 show a rareness calculating method.

As shown in part (c) of FIG. 11, the musical score feature extracting unit 420 calculates the appearance frequency (usage frequency) of each pitch name in two bars before and after a frame for the musical score chroma vectors shown in part (a) of FIG. 11. Then, as shown in part (d) of FIG. 11, the musical score feature extracting unit 420 calculates the usage frequency p, of each pitch name i in two parts before and after. Then, as shown in part (e) of FIG. 11, the musical score feature extracting unit 420 calculates rareness $r_i$ by taking the logarithm of the calculated usage frequency p, of each pitch name i using Expression 7. As shown in Expression 7 and part (e) of FIG. 11, $-\log p_i$ means the extraction of pitch name i with a low usage frequency.

The musical score feature extracting unit 420 outputs the extracted musical score chroma vectors and rareness to the matching unit 440.

Beat Tracking

The beat interval (tempo) calculating unit 430 calculates the beat interval (tempo) from the input audio signal using a beat tracking method (method 2) developed by Murata et al.

Reference 2 (method 2): K. Murata, K. Nakadai, K. Yoshii, R. Takeda, T. Torii, H. G. Okuno, Y. Hasegawa, and H. Tsujino, "A robot uses its own microphone to synchronize its steps to musical beats while scatting and singing", in 2008 IEEE/RSJ International Conference on Intelligent Robots and Systems, pages 2459-2464.

First, the beat interval (tempo) calculating unit 430 transforms a spectrogram p(t,ω) of which the frequency is in linear scale into $p_{mel}(t,\phi)$ of which the frequency is in 64-dimensional Mel-scale using Expression 9. The beat interval (tempo) calculating unit 430 calculates an onset vector d(t,ϕ) using Expression 8.

Expression 8

$$d(t, \varphi) = \begin{cases} p_{mel}^{sobel}(t, \varphi) & (p_{mel}^{sobel}(t, \varphi) > 0) \\ 0 & \text{otherwise} \end{cases} \tag{8}$$

Expression 9

$$p_{mel}^{sobel}(t, \varphi) = -p_{mel}(t-1, \varphi+1) + p_{mel}(t+1, \varphi+1) - 2p_{mel}(t-1, \varphi) + 2p_{mel}(t+1, \varphi) - p_{mel}(t-1, \varphi-1) + p_{mel}(t+1, \varphi-1) \tag{9}$$

Expression 9 means the onset emphasis with a Sobel filter.

Then, the beat interval (tempo) calculating unit 430 estimates the beat interval (tempo). The beat interval (tempo) calculating unit 430 calculates beat interval reliability R(t,k) using normalized cross-correlation by the use of Expression 10.

Expression 10

$$R(t, k) = \frac{\sum_j \sum_{l=0}^{P_w-1} d(t-l, j) d(t-k-l, j)}{\sqrt{\sum_j \sum_{k=l}^{P_w-1} d(t-l, j)^2 \sum_j \sum_{l=0}^{P_w-1} d(t-k-l, j)^2}} \tag{10}$$

In Expression 10, $P_w$ represents the window length for reliability calculation and k represents the time shift parameter. The beat interval (tempo) calculating unit 430 determines the beat interval I(t) on the basis of the time shift value k. The beat interval reliability R(t,k) takes a value of a local peak.

The beat interval (tempo) calculating unit 430 outputs the calculated beat interval (tempo) information to the tempo estimating unit 450.

Matching between Audio Signal and Musical Score

The audio chroma vectors and the onset time information extracted by the audio signal feature extracting unit 410, the musical score chroma vectors and rareness extracted by the musical score feature extracting unit 420, and the stabilized tempo information estimated by the tempo estimating unit 450 are input to the matching unit 440. The matching unit 440 lets $(t_n, f_m)$ be the last matching pair. Here, $t_n$ represents the time in the audio signal and $f_m$ represents the frame index of the musical score. When a new onset time of the audio signal detected at time $t_{n+1}$ and the tempo at that time are considered, the number of frames F to go forward in the musical score is estimated by the matching unit 440 using Expression 11.

Expression 11

$$F = A(t_{n+1} - t_n) \tag{11}$$

In Expression 11, coefficient A corresponds to the tempo. The faster the music is, the larger coefficient A becomes. The weight for musical score frame $f_{m+k}$ is defined as Expression 12.

Expression 12

$$W(k) = \exp\left(-\frac{(f_{m+k} - f_m - F)^2}{2\sigma^2}\right) \tag{12}$$

In Expression 12, k represents the number of onset times in the musical score to go forward and σ represents the variance for the weight. In this embodiment, $\sigma=24$ is set, which corresponds to the half length of a note. Here, it should be noted that k may have a negative value. When k is a negative number, it means that the matching such as $(t_{n+1},f_{m-1})$ is considered, which means that the matching moves backward in the musical score.

The matching unit 440 calculates the similarity between the pair $(t_n,f_m)$ using Expression 13.

Expression 13

$$s(n, m) = \sum_{i=1}^{12} \sum_{\tau=t_n}^{t_{n+1}} r(i, m) c_{sco}(i, m) c_{sig}(i, \tau) \tag{13}$$

In Expression 13, i represents a pitch name, r(i,m) represents rareness $c_{sco}$, and $c_{sig}$ represents the chroma vector generated from the musical score and the audio signal. That is, the matching unit 440 calculates the similarity between the pair $(t_n,f_m)$ on the basis of the product of rareness, the audio chroma vector, and the musical score chroma vector.

When the last matching pair is $(t_n,f_m)$, the new matching is $(t_{n+1},f_{m+k})$ where the number of onset times k in the musical score to go forward is expressed by Expression 14.

Expression 14

$$k = \underset{l}{\operatorname{argmax}} W(l) S(n+1, m+l) \tag{14}$$

In this embodiment, the search range of the number of onset times k in the musical score to go forward for each matching step performed by the matching unit 440 is limited to two bars to reduce the computational cost.

The matching unit 440 calculates the last matching pair $(t_n,f_m)$ using Expressions 11 to 14 and outputs the calculated last matching pair $(t_n,f_m)$ to the singing voice generating unit 130.

Tempo Estimation using Switching Kalman Filter

The tempo estimating unit 450 estimates the tempo using switching Kalman filters (SKF) (method 3) to cope with the matching result and two types of errors in the tempo estimation using the beat tracking method.

Reference 3 (method 3): K. P. Murphy. Switching kalman filters. Technical report, 1998.

Two types of errors to be coped with by the tempo estimating unit 450 are "small errors caused by slight changes of the performance speed" and "errors due to the outliers of the tempo estimation using the beat tracking method". The tempo estimating unit 450 includes the switching Kalman filters and employs two models of a small observation error model 451 and a large observation error model 452 as the outlier.

The switching Kalman filter is an extension of a Kalman filter (KF). The Kalman filter is a linear prediction filter with a state transition model and an observation model. The KF estimates the state from observed values including errors in a discrete time series when the state is unobservable. The switching Kalman filter has a multiple state transition model and an observation model. Every time the switching Kalman filter obtains an observation value, the model is automatically switched on the basis of the likelihood of each model.

In this embodiment, in two models of the small observation error model 451 and the large observation error model 452 as the outlier of the switching Kalman filter, other modeling elements such as the state transition models are common to the two models.

In this embodiment, the SKF model (method 4) proposed by Cemgil et al. is used to estimate the beat time and the beat interval.

Reference 4 (method 4): A. T. Cemgil, B. Kappen, P. Desain, and H. Honing. On tempo tracking: Tempogram representation and Kalman filtering, Journal of New Music Research, 28:4:259-273, 2001.

Suppose that the k-th beat time is $b_k$ and the beat interval at that time is $\Delta_k$ and that the tempo is constant. The next beat time is represented as $b_{k\pm1}=b_k+\Delta_k$ and the beat interval is represented as $\Delta_{k+1}=\Delta_k$. Here, by assuming that vector $x_k=[b_k\Delta_k]^T$, the state transition is expressed as Expression 15.

Expression 15

$$x_{k+1} = F_k x_k + v_k = \begin{bmatrix} 1 & 1 \\ 0 & 1 \end{bmatrix} x_k + v_k \tag{15}$$

In Expression 15, $F_k$ represents a state transition matrix, $v_k$ represents a transition error vector derived from a normal distribution with mean 0 and covariance matrix Q. When it is assumed that the most recent state is $x_k$, the tempo estimating unit 450 estimates the next beat time $b_{k+1}$ as the first component of $x_{k+1}$ expressed by Expression 16.

Expression 16

$$x_{k+1}=F_k x_k \tag{16}$$

Here, let the observation vector be $z_k=[b_k', \Delta_k']^T$, where $b_k'$ represents the beat time calculated from the matching result of the matching unit 440 and $\Delta_k'$ represents the beat interval calculated by the beat interval (tempo) calculating unit 430 using the beat tracking. The tempo estimating unit 450 calculates the observation vector using Expression 17.

Expression 17

$$z_k = H_k x_k + w_k = \begin{bmatrix} 1 & 0 \\ 0 & 1 \end{bmatrix} x_k + w_k \tag{17}$$

In Expression 17, $H_k$ represents an observation matrix and $w_k$ represents the observation error vector derived from a normal distribution with mean 0 and covariance matrix R. In this embodiment, the tempo estimating unit 450 causes the SKF to switch observation error covariance matrices $R^i$ (where i=1, 2), where i represents a model number. Through preliminary experiments, $R^i$ is set as follows in this embodiment. The small error model is $R^1=\mathrm{diag}(0.02, 0.005)$ and the outlier model is $R^2=\mathrm{diag}(1, 0.125)$, where $\mathrm{diag}(a_1, \ldots, a_n)$ represents n×n diagonal matrix of which elements are $a_1, \ldots, a_n$ from the top-left side to the bottom-right side.

Figure 12:
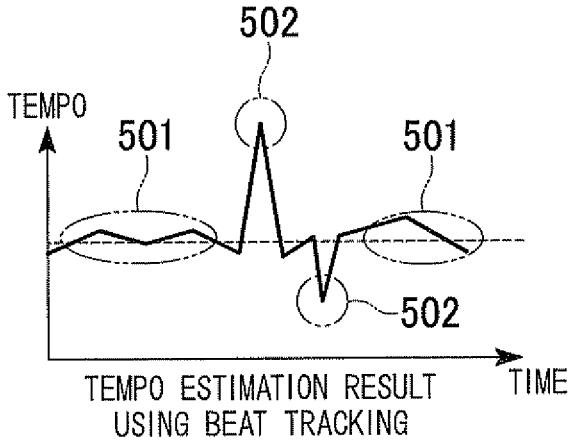
FIG. 12 is a diagram illustrating a beat tracking technique employing a Kalman filter according to the embodiment of the invention.
Figure 12:
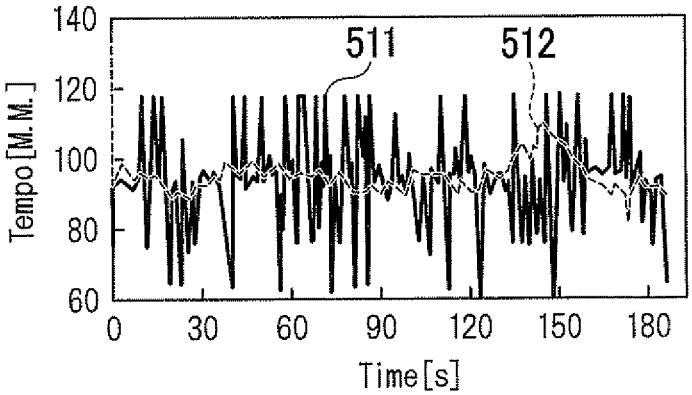

FIG. 12 is a diagram illustrating the beat tracking using Kalman filters. The vertical axis represents the tempo and the horizontal axis represents time. Part (a) of FIG. 12 shows errors in the beat tracking and part (b) of FIG. 12 shows the analysis result using only the beat tracking and the analysis result after the Kalman filter is applied. In part (a) of FIG. 12, the portion indicated by reference numeral 501 represents a small noise and the portion indicated by reference numeral 502 represents an example of the outlier in the tempo estimated using the beat tracking method.

In part (b) of FIG. 12, solid line 511 represents the analysis result of the tempo using only the beat tracking and dotted line 512 represents the analysis result obtained by applying the Kalman filter to the analysis result based on the beat tracking method using the method according to this embodiment. As shown in part (b) of FIG. 12, as the application result of the method according to this embodiment, it is possible to greatly improve the outlier of the tempo, compared with the case where only the beat tracking method is used.

Observation of Beat Time

As described with reference to part (b) of FIG. 9, since the musical score is divided into frames with the length corresponding to a 48th note, the beats lie at every 12 frames. The tempo estimating unit 450 interpolates the calculated beat time $b_k'$ by matching results obtained by the matching unit 440 when no note exists at the k-th beat frame.

The tempo estimating unit 450 outputs the calculated beat time $b_k'$ and the beat interval information to the matching unit 440.

Procedure of Musical Score Position Estimating Process

Figure 13:
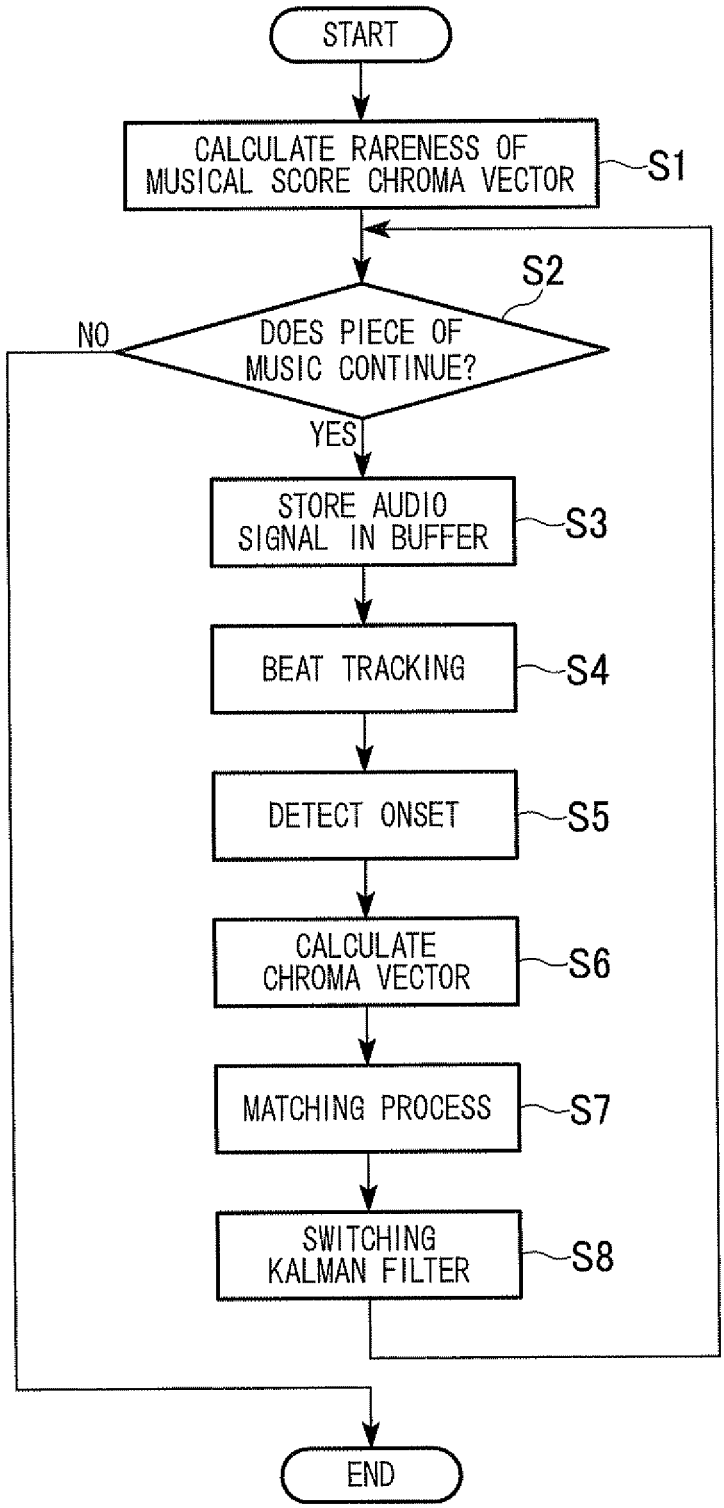
FIG. 13 is a flowchart illustrating a musical score position estimating process according to the embodiment of the invention.

The procedure of the musical score position estimating process performed by the musical score position estimating device 100 will be described with reference to FIG. 13. FIG. 13 is a flowchart illustrating the musical score position estimating process.

First, the musical score feature extracting unit 420 reads the musical score data from the musical score database 121. The musical score feature extracting unit 420 calculates the musical score chroma vector and rareness from the read musical score data using Expressions 5 to 7, and outputs the calculated musical score chroma vector and rareness to the matching unit 440 (step S1).

Then, the musical score position estimating unit 122 determines whether the performance is continued on the basis of the audio signal collected by the microphone 30 (step S2). Regarding this determination, the musical score position estimating unit 122 determines that the piece of music is continuously performed when the audio signal is continued, or determines that the piece of music is continuously performed when the position of the piece of music which is being performed is not the final edge of the musical score.

When it is determined in step S2 that the piece of music is not continuously performed (NO in step S2), the musical score position estimating process is ended.

When it is determined in step S2 that the piece of music is continuously performed (YES in step S2), the audio signal separating unit 110 stores the audio signal collected by the microphone 30 in a buffer of the audio signal separating unit 110, for example, for 1 second (step S3).

Then, the audio signal separating unit 110 extracts the audio signal by making an independent component analysis using the input audio signal and the voice signal generated by the singing voice generating unit 130 and suppressing the reverberated sound and the singing voice, and outputs the extracted audio signal to the musical score position estimating unit 120.

The beat interval (tempo) calculating unit 430 estimates the beat interval (tempo) using the beat tracking method and Expressions 8 to 10 on the basis of the input musical signal, and outputs the estimated beat interval (tempo) to the matching unit 440 (step S4).

The audio signal feature extracting unit 410 detects the onset time information from the input audio signal using Expression 4, and outputs the detected onset time information to the matching unit 440 (step S5).

The audio signal feature extracting unit 410 extracts the audio chroma vector using Expressions 8 to 3 on the basis of the input audio signal, and outputs the extracted audio chroma vector to the matching unit 440 (step S6).

The audio chroma vector and the onset time information extracted by the audio signal feature extracting unit 410, the musical score chroma vector and rareness extracted by the musical score feature extracting unit 420, and the stable tempo information estimated by the tempo estimating unit 450 are input to the matching unit 440. The matching unit 440 sequentially matches the input audio chroma vector and musical score chroma vector using Expressions 11 to 14, and estimates the last matching pair $(t_n, f_m)$. The matching unit 440 outputs the last matching pair $(t_n, f_m)$ corresponding to the estimated musical score position to the tempo estimating unit 450 and the singing voice generating unit 130 (step S7).

On the basis of the beat interval (tempo) information input from the beat interval (tempo) calculating unit 430, the tempo estimating unit 450 calculates the beat time $b_k'$ and the beat interval information using Expressions 15 to 3 and outputs the calculated beat time $b_k'$ and the calculated beat interval information to the matching unit 440 (step S8).

The last matching pair $(t_n, f_m)$ is input to the tempo estimating unit 450 from the matching unit 440. The tempo estimating unit 450 interpolates the calculated beat time $b_k$ by the matching result in the matching unit 440 when no note exists in the k-th beat frame.

The matching unit 440 and the tempo estimating unit 450 sequentially perform the matching process and the tempo estimating process, and the matching unit 440 estimates the last matching pair $(t_n, f_m)$.

The voice generating unit 132 of the singing voice generating unit 130 generates a singing voice of words and melodies corresponding to the musical score position with reference to the word and melody database 131 on the basis of the input last matching pair $(t_n, f_m)$. Here, the "singing voice" is voice data output through the speaker 20 from the musical score position estimating device 100. That is, since the sound is output through the speaker 20 of the robot 1 having the musical score position estimating unit 100, it is called a "singing voice" for the purpose of convenience. In this embodiment, the voice generating unit 132 generates the singing voice using VOCALOID (registered trademark (VOCALOID2)). Since the VOCALOID (registered trademark (VOCALOID2)) is an engine for synthesizing a singing voice based on a human voice sampled by inputting the melodies and words, the singing voice does not depart from the actual performance by adding the musical score position as information in this embodiment.

The voice generating unit 132 outputs the generated voice signal from the speaker 20.

After the last matching pair $(t_n, f_m)$ is estimated, the processes of steps S2 to S8 are sequentially performed until the performance of a piece of music is finished.

In this way, by estimating the musical score position, generating a voice (singing voice) corresponding to the estimated musical score position, and outputting the generated voice from the speaker 20, the robot 1 can sing to the performance. According to this embodiment, since the position of a portion in the musical score is estimated on the basis of the audio signal in performance, it is possible to accurately estimate the position of a portion in the musical score even when a piece of music is started from the middle part thereof.

Evaluation Result

The evaluation result using the musical score position estimating device 100 according to this embodiment will be described. First, test conditions will be described. The pieces of music used in the evaluation were 100 pieces of popular music in the RWC research music database (RWC-MDB-P-

2001;http://staff.aist.go.jp/m.goto/RWC-MDB/index-j.html) prepared by GOTO et al. Regarding the used pieces of music, the full-version pieces of music including the singing parts or the performance parts were used.

The answer data of musical score synchronization was generated from MIDI files of the pieces of music by an evaluator. The MIDI files are accurately synchronized with the actual performance. The error is defined as an absolute difference between the beat times extracted per second in this embodiment and the answer data. The errors are averaged every piece of music.

The following four types of methods were evaluated and the evaluation results were compared.

(i) Method according to this embodiment: SKF and rareness are used.

(ii) Without SKF: Tempo estimation is not modified.

(iii) Without rareness: All notes have equal rareness.

(iv) Beat tracking method: This method determines the musical score position by counting the beats from the beginning of the music.

Furthermore, by using two types of music signals, it was evaluated what influence the sound collected by the microphone 30 of the musical score position estimating device 100 have on the reverberation in the room environment.

(v) Clean music signal: music signal without reverberation (vi) Reverberated music signal: music signal with reverberation.

Figures 14, 15:
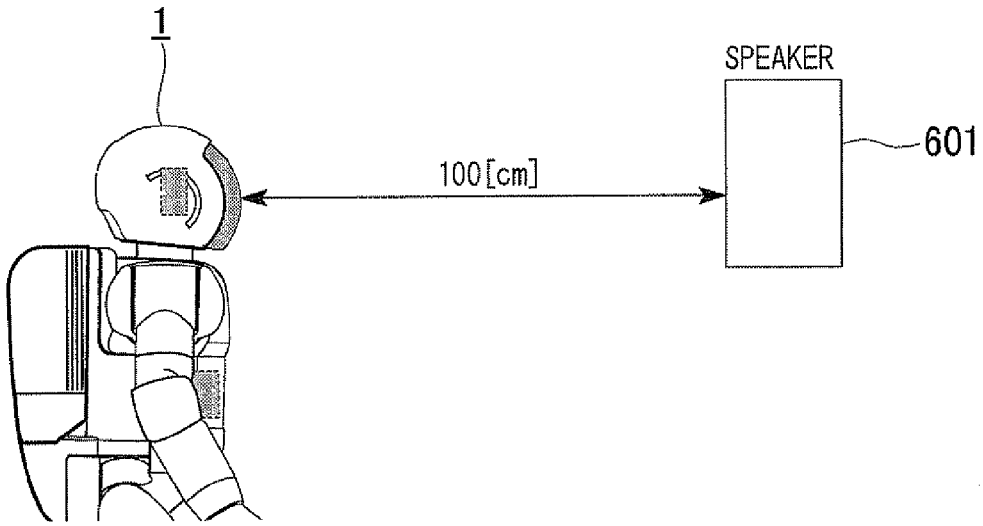
FIG. 14 is a diagram illustrating a setup relation of a robot having the musical score position estimating device and a sound source.
FIG. 15 is a diagram illustrating two kinds of musical signals ((v) and (vi)) and results of four methods ((i) to (iv)).

The reverberation was simulated by impulse response convolution. FIG. 14 is a diagram illustrating a setup relation of the robot 1 having the musical score position estimating device 100 and a sound source. As shown in FIG. 14, a sound source output from a speaker 601 disposed at a position apart by 100 cm from the front of the robot 1 was used as the sound source for evaluation. The generated impulse response was measured in an experimental room. The reverberation time (RT20) in the experimental room is 156 sec. An auditorium or a music hall would have a longer reverberation time.

FIG. 15 shows the results of two types of music signals (v) and (vi) and four methods (i) to (iv). The values are averages of cumulative absolute errors and standard deviations of 100 pieces of music. In both the clean signal and the reverberated signal, the magnitude of error when using the method (i) according to this embodiment is smaller than the magnitude of error when using the beat tracking method (iv). In the method (i) according to this embodiment, the magnitude of error is reduced by 29% in the clean signal and by 14% in the reverberated signal. Since the magnitude of error when using the method (i) according to this embodiment is smaller than the magnitude of error when using the method (ii) without the SKF, it can be seen that the magnitude of error is reduced by using the SKF. Comparing the method (i) according to this embodiment with the method (iii) without rareness, it can be seen that rareness reduces the magnitude of error.

Since the magnitude of error when using the method (ii) without the SKF is larger than the magnitude of error when using the method (iii) without rareness, it can be said that the SKF is more effective than rareness. This is because rareness often causes a high similarity between the frames in the musical score and the incorrect onset times such as drum sounds. If drum sounds accompany high rareness and have high power in the chroma vector component, this causes incorrect matching. To avoid this problem, the musical score position estimating device 100 can consider rareness of combined pitch names, not a single pitch name.

Figure 16:
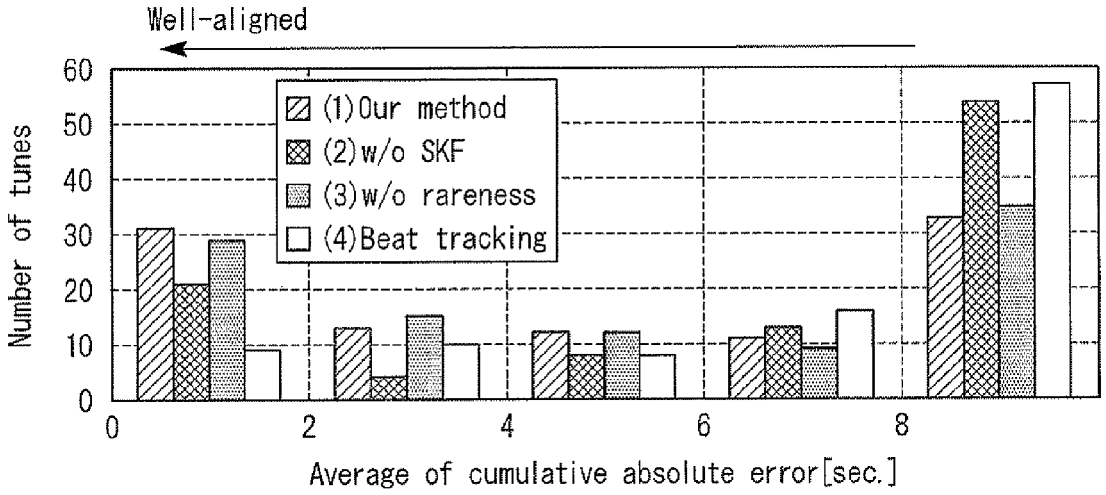
FIG. 16 is a diagram illustrating the number of tunes classified by the average of cumulative absolute errors in various methods in the case of a clean signal.
Figure 17:
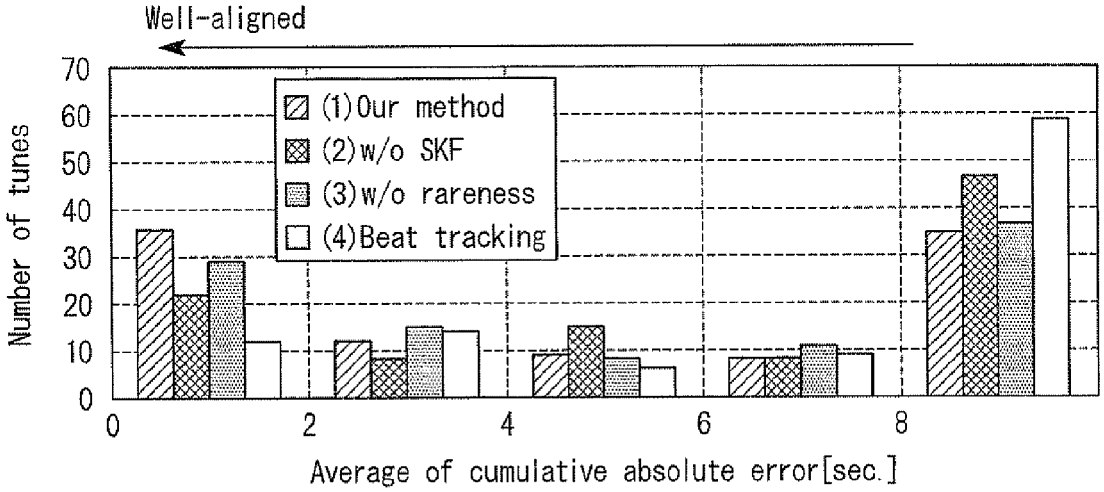
FIG. 17 is a diagram illustrating the number of tunes classified by the average of cumulative absolute errors in various methods in the case of a reverberated signal.

FIG. 16 is a diagram illustrating the number of tunes classified by the average of cumulative absolute errors in various methods in the case of a clean signal. FIG. 17 is a diagram illustrating the number of tunes classified by the average of cumulative absolute errors in various methods in the case of a reverberated signal. In FIGS. 16 and 17, if the number of tunes with a smaller average error becomes larger, it means a more excellent performance. With the clean signal, the number of tunes having an error of 2 seconds or less is 31 in our method (i), but the number of tunes is 9 in the method (iv) using only the beat tracking method.

Regarding the reverberated signal, the number of pieces of music having an error of 2 seconds or less was 36 in the method (i) according to this embodiment, but was 12 in the method (iv) using only the beat tracking method. In this way, since the position of a portion in the musical score can be estimated with smaller errors, the method according to this embodiment is better than the beat tracking method. This is essential to the generation of natural singing voices to the music.

In the classification using the method according to this embodiment, there is no great difference between the clean signal and the reverberated signal, but the method according to this embodiment has greater errors in the reverberated signal, as shown in FIG. 15. Accordingly, the reverberation in the experimental room has an influence on the piece of music including greater errors. The reverberation has less influence on the piece of music including small errors. In an environment having longer reverberation such as a music hall, it is also considered that it has a bad effect on the precision of the musical score synchronization.

Accordingly, in this embodiment, since the audio signal having been subjected to the independent component analysis to suppress the reverberation sounds by the audio signal separating unit 110 is used to estimate the musical score position, it is possible to reduce the influence of the reverberation in this case, thereby synchronizing the musical score with high precision.

Accordingly, by comparing the errors of the pieces of music having drum sounds and having no drum sound with each other, it was tested that the precision of the method according to this embodiment depends on the playing of a drum in the musical score. The number of pieces of music having a drum sound and the number of pieces of music having no drum sound are 89 and 11, respectively. The average of the cumulative absolute errors of the pieces of music having a drum sound is 7.37 seconds and the standard deviation thereof is 9.4 seconds. On the other hand, the average of cumulative errors of the pieces of music having no drum sound is 22.1 seconds and the standard deviation thereof is 14.5 seconds. The tempo estimation using the beat tracking method can easily cause a very great variation when there is no drum sound. This is a reason for inaccurate matching causing a high cumulative error.

In this embodiment, to reduce the influence of a low-pitched sound region like a drum, the high-frequency component is weighted and the onset time is detected from the weighted power, as shown in FIG. 10, whereby it is possible to make a match with higher precision.

In this embodiment, it has been stated that the musical score position estimating device 100 is applied to the robot 1 and the robot 1 sings to performance (singing voices are output from the speaker 20). However, on the basis of the estimated musical score position information, the control unit of the robot 1 may control the robot 1 to move its movable parts to the performance as if the robot 1 moves its body to the performance and rhythms.

In this embodiment, it has been stated that the musical score position estimating device 100 is applied to the robot 1, but the musical score position estimating device may be applied to other apparatuses. For example, the device may be applied to a mobile phone or the like or may be applied to a singer apparatus singing to a performance.

In this embodiment, it has been stated that the matching unit 440 performs the weighting using rareness, but the weighting may be carried out using different factors. When it is determined that the appearance frequency of a musical note is low it can be considered that the musical note of which the appearance frequency is low is high in appearance frequency in frames before and after a specific frame. In this case, the musical note having the high appearance frequency or the musical note having the average appearance frequency may be used.

In this embodiment, it has been stated that the beat interval (tempo) calculating unit 430 divides a musical score into frames with a length corresponding to a 48th note, but the frames may have a different length. It has been stated that the buffering time is 1 second, but the buffering time may not be 1 second and data for a time longer than the time of the processing may be included.

The above-mentioned operations of the units according to the embodiment of the invention shown in FIGS. 2 and 7 may be performed by recording a program for performing the operations of the units in a computer-readable recording medium and causing a computer system to read the program recorded in the recording medium and to execute the program. Here, the "computer system" includes an OS or hardware such as peripherals.

The "computer system" includes a homepage providing environment (or display environment) in using a WWW system.

Examples of the "computer-readable recording medium" include memory devices of portable mediums such as a flexible disk, a magneto-optical disk, a ROM (Read Only Memory), and a CD-ROM, a USB memory connected via a USB (Universal Serial Bus) I/F (Interface), and a hard disk built in the computer system. The "computer-readable recording medium" may include a recording medium dynamically storing a program for a short time like a transmission medium when the program is transmitted via a network such as Internet or a communication line such as a phone line, and a recording medium storing a program for a predetermined time like a volatile memory in a computer system serving as a server or a client in that case. The program may embody a part of the above-mentioned functions. The program may embody the above-mentioned functions in cooperation with a program previously recorded in the computer system.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A musical score position estimating device comprising:

an audio signal acquiring unit;

a musical score information acquiring unit acquiring musical score information corresponding to an audio signal acquired by the audio signal acquiring unit;

an audio signal feature extracting unit extracting a feature amount of the audio signal;

a musical score feature extracting unit extracting a feature amount of the musical score information;

a beat position estimating unit estimating a beat position of the audio signal; and a matching unit matching the feature amount of the audio signal with the feature amount of the musical score information using the estimated beat position to estimate a position of a portion in the musical score information corresponding to the audio signal, wherein the musical score feature extracting unit calculates rareness which is an appearance frequency of a musical note from the musical score information, and wherein the matching unit makes a match using the rareness.

2. The musical score position estimating device according to claim 1, wherein the matching unit makes a match on the basis of the product of the calculated rareness, the extracted feature amount of the audio signal, and the extracted feature amount of the musical score information.

3. The musical score position estimating device according to claim 1, wherein the rareness is the lowness in appearance frequency of a musical note in the musical score information.

4. The musical score position estimating device according to claim 1, wherein the audio signal feature extracting unit extracts the feature amount of the audio signal using a chroma vector, and wherein the musical score feature extracting unit extracts the feature amount of the musical score information using a chroma vector.

5. The musical score position estimating device according to claim 1, wherein the audio signal feature extracting unit weights a high-frequency component in the extracted feature amount of the audio signal and calculates an onset time of a musical note on the basis of the weighted feature amount, and wherein the matching unit makes a match using the calculated onset time of the musical note.

6. The musical score position estimating device according to claim 1, wherein the beat position estimating unit estimates the beat position by switching a plurality of different observation error models using a switching Kalman filter.

7. A musical score position estimating method comprising:

an audio signal acquiring step of acquiring an audio signal;

a musical score information acquiring step of acquiring musical score information corresponding to the acquired audio signal;

an audio signal feature extracting step of extracting a feature amount of the audio signal;

a musical score information feature extracting step of extracting a feature amount of the musical score information;

a beat position estimating step of estimating a beat position of the audio signal; and a matching step of matching the feature amount of the audio signal with the feature amount of the musical score information using the estimated beat position to estimate a position of a portion in the musical score information corresponding to the audio signal, wherein, in the musical score information feature extracting step, rareness, which is an appearance frequency of a musical note, is calculated from the musical score information, and wherein, in the matching step, matching is performed using the rareness.

8. A musical score position estimating robot comprising:

an audio signal acquiring unit;

an audio signal separating unit extracting an audio signal corresponding to a performance by performing a suppression process on the audio signal acquired by the audio signal acquiring unit;

a musical score information acquiring unit acquiring musical score information corresponding to the audio signal extracted by the audio signal separating unit;

an audio signal feature extracting unit extracting a feature amount of the audio signal extracted by the audio signal separating unit;

a musical score feature extracting unit extracting a feature amount of the musical score information;

a beat position estimating unit estimating a beat position of the audio signal extracted by the audio signal separating unit; and a matching unit matching the feature amount of the audio signal with the feature amount of the musical score information using the estimated beat position to estimate a position of a portion in the musical score information corresponding to the audio signal, wherein the musical score feature extracting unit calculates rareness which is an appearance frequency of a musical note from the musical score information, and wherein the matching unit makes a match using the rareness.

9. A musical score position estimating device comprising:

an audio signal acquiring unit;

a musical score information acquiring unit acquiring musical score information corresponding to an audio signal acquired by the audio signal acquiring unit;

an audio signal feature extracting unit extracting a feature amount of the audio signal;

a musical score feature extracting unit extracting a feature amount of the musical score information;

a beat position estimating unit estimating a beat position of the audio signal; and a matching unit matching the feature amount of the audio signal with the feature amount of the musical score information using the estimated beat position to estimate a position of a portion in the musical score information corresponding to the audio signal, wherein the audio signal feature extracting unit extracts the feature amount of the audio signal using a chroma vector, and wherein the musical score feature extracting unit extracts the feature amount of the musical score information using a chroma vector.

10. A musical score position estimating device comprising:

an audio signal acquiring unit;

a musical score information acquiring unit acquiring musical score information corresponding to an audio signal acquired by the audio signal acquiring unit;

an audio signal feature extracting unit extracting a feature amount of the audio signal;

a musical score feature extracting unit extracting a feature amount of the musical score information;

a beat position estimating unit estimating a beat position of the audio signal; and a matching unit matching the feature amount of the audio signal with the feature amount of the musical score information using the estimated beat position to estimate a position of a portion in the musical score information corresponding to the audio signal, wherein the beat position estimating unit estimates the beat position by switching a plurality of different observation error models using a switching Kalman filter.

* * * * *